United States Patent [19]

Bertoletti

[11] Patent Number: 4,946,160

[45] Date of Patent: Aug. 7, 1990

[54] INCLINABLE ROTARY PLATFORM APPARATUS FOR PHYSICAL TRAINING, PARTICULARLY OF PRE-SKI TYPE

[76] Inventor: Giovanni Bertoletti, 25036 Palazzolo Sull-Oglio, Brescia, Italy

[21] Appl. No.: 339,648

[22] Filed: Apr. 18, 1989

[30] Foreign Application Priority Data

Apr. 18, 1988 [IT] Italy ..... 2927 A/88

[51] Int. Cl.[5] ..... A63B 69/00

[52] U.S. Cl. ..... 272/97; 272/146

[58] Field of Search ..... 272/97, 146, 109, 133, 272/28 R, 28 S, 36, 39; 434/253

[56] References Cited

U.S. PATENT DOCUMENTS

| | | | |
|---|---|---|---|
| 3,352,559 | 11/1967 | Larson | 272/146 |
| 3,471,144 | 10/1969 | Boucard | 272/146 |
| 3,485,493 | 12/1969 | Pitkanen | 272/111 |
| 3,531,110 | 9/1970 | Marchu | 272/97 |
| 3,582,066 | 6/1971 | Keryluk | 272/97 |
| 3,591,172 | 7/1971 | Hude | 272/97 |
| 4,629,181 | 12/1986 | Krive | 272/97 |

*Primary Examiner*—Stephen R. Crow

*Attorney, Agent, or Firm*—Steinberg & Raskin

[57] ABSTRACT

The invention relates to an apparatus for physical training, particularly of pre-ski type characterized by a base which rests on the ground and engages with an upper platform in such manner as to enables the latter to move angularly about a vertical axis as the result of a rocking movement about a horizontal axis imposed by the sportsman's feet bearing on the upper platform. The apparatus is also characterized by a stout belt to be worn by the sportsman and used to anchor an elastic cable fixed to the upper platform, in order to compel the feet to undergo a reactive force.

6 Claims, 2 Drawing Sheets

S
23
26B
24B
25B
2
5
4
1
3
22
26A
24A
25A 18
17
16
27
28
16A
4'
22
19B
15
8
9
19A
24
10
20
19
11B
11C
13
14
11
21
5'
6
1'
3'
2
12
7
6A
11A

INCLINABLE ROTARY PLATFORM APPARATUS FOR PHYSICAL TRAINING, PARTICULARLY OF PRE-SKI TYPE

BACKGROUND OF THE INVENTION

This invention relates to the field of physical training apparatus and particularly to apparatus for pre-ski physical training.

It is well known that certain sporting activities can be performed at a high level of athletic commitment only after preparative physical training for the purpose of gradually toning the muscles and general body structure. This is particularly necessary in skiing, in which the violent and sudden stresses created by the snow-laden ground during descents impose considerable muscular reactions.

Athletic preparation becomes more effective the more gradual or prolonged it is, so that often such preparations cannot be satisfactorily carried out in ski resorts because of the overwhelming temptations to ski offered by the ski trails.

SUMMARY OF THE INVENTION

An object of the present invention is to provide a physical training apparatus which allows effective athletic preparation, particularly for pre-ski preparation, even in the home or generally removed from ski resorts.

A further object is to provide an apparatus which is easily transported.

A still further object is to provide a simple and strong apparatus and another object is to provide an apparatus which has adjustable dynamic stimulus parameters.

These and further objects, which will be apparent from a reading of the following detailed description, are attained by an apparatus for physical training, particularly for pre-ski physical training, characterized by a base which cause rests on the ground and engages an upper platform by means which causes the latter to move angularly about a vertical axis as the result of a rocking movement about a horizontal axis imposed by the sportsman's feet bearing on the upper platform.

The engagement means between the base and the upper platform consists essentially of a pair of half-wheels, about the axis of a rigid upper platform, one of the half-wheels being frictionally engaged with the base and the other being rotationally independent of the base, so that as the half-wheels move angularly about their horizontal axis as the result of an inclination imposed on the upper platform by the feet of the person sportsman, the half-wheels, and thus the upper platform of which they form part, are made to orbit about a vertical axis, only one of said half-wheels being torsionally engaged with the base.

BRIEF DESCRIPTION OF THE DRAWINGS

The invention is illustrated by way of non-limiting example in the accompanying drawing in which.

DESCRIPTION OF PREFERRED EMBODIMENTS

Figures 1, 2:
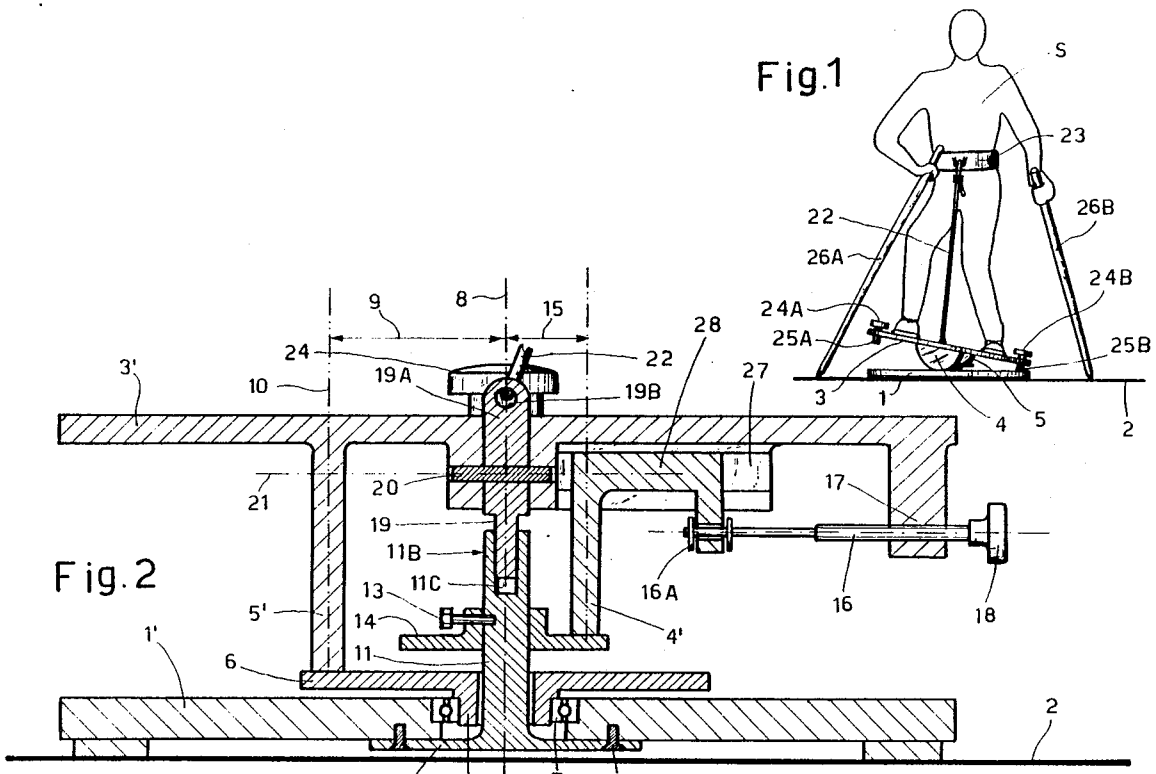
FIG. 1 shows a sportsman standing on the apparatus.
FIG. 2 is a section through the center of the apparatus.
Figure 3:
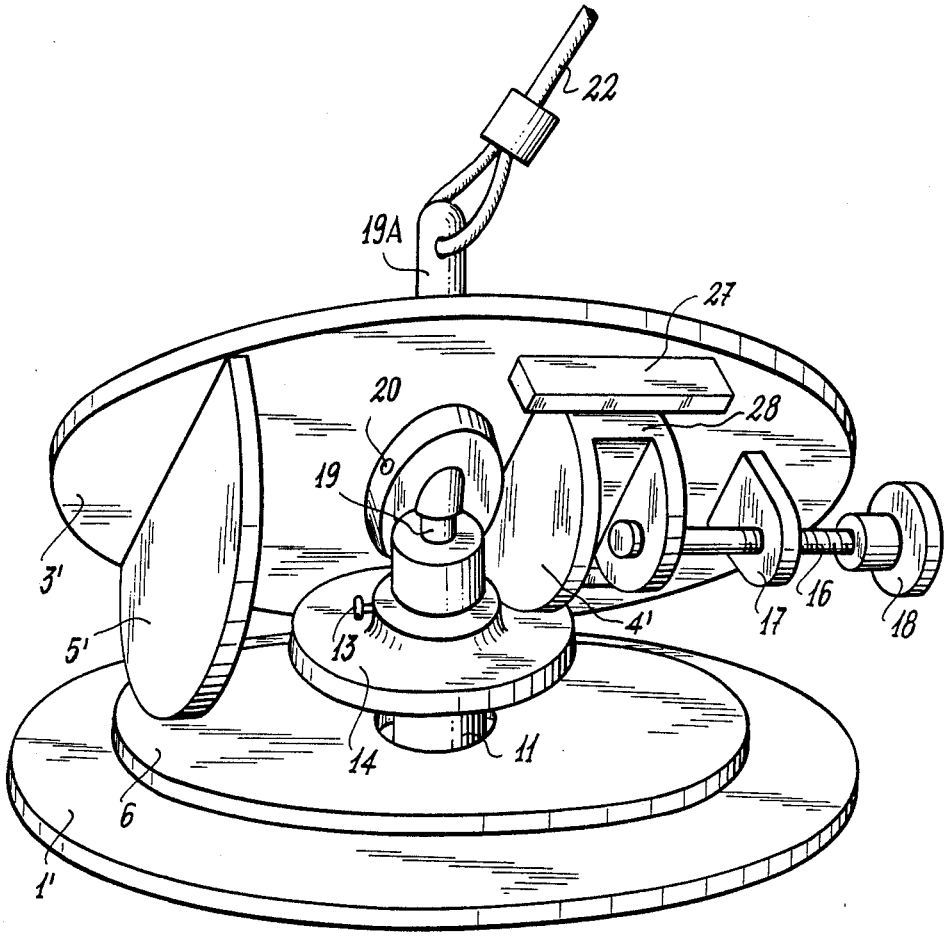
FIG. 3 is a prespective view of the apparatus

With reference to FIG. 1 and assuming both half-wheels 4 and 5 to be rigid with the platform 3 (i.e. as though they form a half cylinder) it is clear that the platform 3, which rests on said wheels such that they act as a fulcrum, is caused to rock to the right or left by the thrusts exerted by the feet of the sportsman S.

If instead of two wheels on the horizontal axis only one wheel positioned offset form the veritcal axis is used, then the assumed simple rocking is no longer possible. Under these conditions, the advantageous combined movement is obtained which characterizes the present invention.

The wheel, or half-wheel, is in fact caused in this manner to rock on the base not only about its own axis but also "with" its own axis, to orbit about a circumference of the vertical axis. The motion to which the platform 3 is subjected is conceptually similar to that of a half-cone of an essentially horizontal axis which rolls on a cone having an essentially vertical axis which intersects the horizontal axis.

From a constructional viewpoint, rather than using orthogonal or skew cones, these platform movements can be obtained more economically using other methods, of which that of FIG. 2 is one example.

A base 1', of preferably discoidal shape, forms the support for a first flange 6 mounted on one or more rolling-contact bearings 7. The bearing 7 supports the weight of the sportsman 8, and it must therefore be suitable to withstand axial loads. It could therefore be a radial ball bearing with deep races. On this first flange, which is movable about a vertical axis 8, first half-wheel 5' rests, this half wheel 5' being rigid with a platform 3' and disposed in a plane 10 which is offset by a distnce 9 from the axis 8. In a position coaxial with its hub 6A the first flange 6 carries a fixed shaft 11 which is made rigid with the base 1' by fixing its edge 11A with screws 12.

A second flange 14 is fixed onto said shaft by usual means, such as a screw 13. Said second flange is above the first flange 6 and is not in contact with it. The fixed shaft 11 is arranged at a distance from the bore of the hub 6A of the first flange by a suitable clearance.

A second half-wheel 4' smaller than the half-wheel 5' rests on the second flange 14. The second half-wheel 4' is also rigid with the platform 3', but indirectly.

In this respect, it is provided with a slide 28 slidable radially in a guide 27 rigid with the platform 3' and its degree of offset 15 from the veritcal axis is adjustable by means of screw 16 which screws into or out of a lead nut 17 rigid with platform 3'. Said screw 16 is provided with an operating knob 18 and usual means 16A for shifting the second half-wheel 4' mounted on the slide 28. In the top 11B of the fixed shaft 11 there is provided a bore 11C in which a shank 19 is slidable, and is fixed to the platform 3' by a transverse pin 20 of axis 21.

The axis 21 of this pin represents the horizontal rocking axis of the platform 3'. On a head part 19A of the shank there is provided a ring 19B for fixing an elastic cable 22 hooked to a stout belt 23 tightened about the hips of the sportsman S. The purpose of this elastic cable is to cause a preload to act on the sportsman's legs and to thereby stimulate the muscles.

The preload is adjustable by varying the length of the elastic cable used. This adjustment can be done by various known means. By way of example, a "cable throttler" can be adopted, of the type commonly used in the nautical field and generally based on the use of a unidirectional self-wedging pawl which can be disengaged on command.

The platform 3 (3') is provided in a peripheral position with knobs 24A and 24B the threaded ends of which form, on the lower side of the platform through which they are screwed, projections 25A and 25B which strike the base 1 to limit the angular amplitude of the rocking movement.

From the foregoing, it is apparent that if the sportsman S presses with one foot more than the other, he causes the platform 3 (3') to rock and simultaneously rotate about itself, thus subjecting the sportsman's body to a twisting action against which he reacts by acting on the ground with sticks 26A and 26B. As his feet rest on a surface undergoing rocking movement with variable inclination in space, they transmit throughout his body stimulating reactions as he restores his equilibrium.

This facility for simultaneous rotation and inclination of the platform derives from the fact that of the pair of half-wheels 4' and 5', only one half-wheel (i.e. 4') is able to transmit propulsive forces to the base 1, (1)' (second flange 14).

In this respect, the other half-wheel, by resting on the first flange 6 provided with the bearing 7, receives practically no reaction. This fact means that the apparatus according to the invention could also be formed in other ways, such as by means of a wheel rotating idly about its axis and resting directly on the fixed base (replacing for example the half-wheel 5' and the first flange 6), without departing from the scope of the invention.

Conventional arrangements are used in all cases to increase the friction between the elements in engagement between the base 1 and platform 3. By way of example, with referene to the embodiment of FIG. 2, the second flange 14 has its upper surface covered with rubber, on which the half-wheel 4' can roll without slipping. Another friction-creating surface is the upper surface of the platform. In this case, the friction acts on the feet resting on it and is obtainable in various ways. For example, the surface can comprise projections extending parallel to the length of the feet to prevent transverse sliding. The position to be taken by the feet on the platform can be identified by the parallel lines formed by said projections, but can be more advantageously defined by suitable designs indicating two feet in plan view, and within which the sportsman S is to place his feet.

It can be seen from the above, that the greater the offset 15, the smaller the angle through which the half-wheel 4' moves as its semi-circumference moves through the corresponding arc on the second flange 14.

I claim:

1. Apparatus for physical training, particularly for pre-ski purposes, said apparatus comprising a base (1, 1') which rests on ground (2) and engages an upper platform (3, 3') by engagement means which permit the upper platform to move angularly about a vertical axis (8) upon rocking movement about a horizontal axis (21) caused by the feet of a person (S) carrying out said physical training which bear on said upper platform, said engagement means comprising a pair of half wheels (4-5, 4'-5') rockable about said horizontal axis (21) of said upper platform, one of said half wheels being engaged by friction on the base, and the other half wheel being rotationally independent of said base, so that said half wheels move angularly about said horizontal axis as the result of inclination imposed on the upper platform by the feet of the person, said half wheels and the upper platform to which they are engaged thus being made to orbit about a vertical axis (8), only one of said half wheels being torsionally engaged with the base.

2. Apparatus according to claim 1, and also including a belt to be worn by the person carrying out the physical training and being anchored to an elastic cable (22) fixed to said upper platform, thus compelling the feet of the person to undergo a reactive force.

3. Apparatus according to claim 1 wherein the inclination is adjustable by screw adjustment projections (**24*a*, 24*b*) interposed between the base and the platform, said screw adjustment being effected by knobs (24*a*, 24*b***).

4. Apparatus according to claim 1 wherein angular rocking about the vertical axis is adjusted by varying the radial distance (15) to the point of contact between the half wheel (4,4') and a fixed portion of said base.

5. Apparatus according to claim 4 wherein radial distance variation is effected by screw means.

6. Apparatus according to claim 4 wherein adjustment of the radial distance to the point of contact between the half wheel (4,4') and a fixed portion of the base is effected by a slide (28) which is moved by screw means (16) operated by a knob (18) and assisted by a slide guide (27).

* * * * *